US007934943B2

(12) United States Patent
Malstrom et al.

(10) Patent No.: US 7,934,943 B2
(45) Date of Patent: May 3, 2011

(54) STRAIN RELIEF BOOT FOR A CONNECTOR AND CABLE ASSEMBLY

(75) Inventors: Charles R. Malstrom, Lebanon, PA (US); Takahito Sengoku, Kanagawa (JP); John Joseph Consoli, Harrisburg, PA (US)

(73) Assignees: Tyco Electronics Corporation, Berwyn, PA (US); Tyco Electronics AMP K.K., Kanagawa-Ken (JP)

( * ) Notice: Subject to any disclaimer, the term of this patent is extended or adjusted under 35 U.S.C. 154(b) by 252 days.

(21) Appl. No.: 12/262,554

(22) Filed: Oct. 31, 2008

(65) Prior Publication Data

US 2010/0112849 A1 May 6, 2010

(51) Int. Cl.
*H01R 13/56* (2006.01)

(52) U.S. Cl. ..... 439/447

(58) Field of Classification Search ..... 439/731, 439/687, 447, 482, 418, 460, 941, 607.48, 439/607.51, 445
See application file for complete search history.

(56) References Cited

U.S. PATENT DOCUMENTS

| | | | | |
|---|---|---|---|---|
| 5,833,495 | A * | 11/1998 | Ito | 439/607.48 |
| 6,672,774 | B2 | 1/2004 | Theuerkorn | |
| 7,163,424 | B2 * | 1/2007 | Dancel et al. | 439/731 |
| 7,229,309 | B2 * | 6/2007 | Carroll et al. | 439/418 |

* cited by examiner

*Primary Examiner* — Edwin A. Leon

(57) ABSTRACT

A connector assembly is provided for terminating an end portion of a cable that includes a conductor. The connector assembly includes a housing and a contact held by the housing. The contact is configured to be connected to the conductor of the cable. A cover is configured to surround at least a portion of the end portion of the cable. A strain relief boot is configured to surround at least a portion of the cover and at least a portion of the end portion of the cable. The strain relief boot includes a cover latch component that is configured to directly connect the strain relief boot to the cover. The strain relief boot includes a housing latch component that is configured to directly connect the strain relief boot to the housing.

19 Claims, 8 Drawing Sheets

STRAIN RELIEF BOOT FOR A CONNECTOR AND CABLE ASSEMBLY

BACKGROUND OF THE INVENTION

The subject matter described and/or illustrated herein relates generally to connectors, and more particularly, to a strain relief boot for a connector that terminates the end portion of a cable.

Connectors that terminate the end portion of a cable often include one or more contacts that are connected to one or more corresponding conductors of the cable. The contacts are typically held by a housing. At least some known connectors that terminate the end portion of a cable include a strain relief boot that covers the end portion of the cable that is terminated by the connector. As the name suggests, the strain relief boot reduces strain on the cable. For example, the strain relief boot may reduce strain when the cable is pulled on to avoid over-bending the cable. Such over-bending of the cable may lead to attenuation and even breakage of the conductors within the cable. Moreover, over-bending of the cable may weaken and/or damage an insulating jacket of the cable.

At least some known strain relief boots extend over a ferrule or cover that surrounds the end portion of the cable. The strain relief boot may be connected to the cover or ferrule to hold the strain relief boot on the end portion of the cable. However, the strain relief boots of at least some known connectors that terminate the end portion of a cable do not provide strain relief to the housing. Over-bending of the cable may thereby result in damage to the housing and/or the contacts held by the housing, and/or may cause the contacts to be pulled out of the housing.

There is a need for providing strain relief to a housing of a connector that terminates the end portion of a cable.

BRIEF DESCRIPTION OF THE INVENTION

In one embodiment, a connector assembly is provided for terminating an end portion of a cable that includes a conductor. The connector assembly includes a housing and a contact held by the housing. The contact is configured to be connected to the conductor of the cable. A cover is configured to surround at least a portion of the end portion of the cable. A strain relief boot is configured to surround at least a portion of the cover and at least a portion of the end portion of the cable. The strain relief boot includes a cover latch component that is configured to directly connect the strain relief boot to the cover. The strain relief boot includes a housing latch component that is configured to directly connect the strain relief boot to the housing.

Optionally, the housing latch component of the strain relief boot includes an extension and the housing includes a slot, wherein the extension is configured to be received within the slot to directly connect the strain relief boot to the housing. The strain relief boot optionally includes a slot that is configured to receive a portion of the housing therein. In some embodiments, at least a portion of an end portion of the strain relief boot is configured to overlap the housing. Optionally, the housing includes a slot and the strain relief boot includes an end portion having a flap that is configured to overlap the housing, wherein the flap includes the housing latch component.

Optionally, the cover latch component of the strain relief boot includes a protrusion and the cover includes a groove, wherein the protrusion is configured to be received within the groove to directly connect the strain relief boot to the cover. In some embodiments, the strain relief boot and the cover each extends a length along a longitudinal axis, the cover latch component of the strain relief boot includes a plurality of protrusions that are located at different axial locations along the longitudinal axis, and the cover includes a plurality of grooves that are located at different axial locations along the longitudinal axis, wherein each of the protrusions is configured to be received within a corresponding one of the grooves to directly connect the strain relief boot to the cover.

In another embodiment, a connector and cable assembly includes a cable having an end portion and a conductor, and a connector sub-assembly terminating the end portion of the cable. The connector sub-assembly includes a housing and a contact held by the housing. The contact is connected to the conductor of the cable. A cover surrounds at least a portion of the end portion of the cable. A strain relief boot surrounds at least a portion of the cover and at least a portion of the end portion of the cable. The strain relief boot is directly connected to both the cover and the housing.

In another embodiment, a connector includes a contact holder extending a length along a longitudinal axis. The contact holder includes a latch component having a first stop shoulder and a second stop shoulder. A contact is held by the contact holder. A housing holds the contact holder. The housing includes a latch wall having a first stop surface and a second stop surface. The first stop surface is configured to engage the first stop shoulder of the contact holder to prevent the housing from moving along the longitudinal axis relative to the contact holder in a first direction. The second stop surface is configured to engage the second stop shoulder of the contact holder to prevent the housing from moving along the longitudinal axis relative to the contact holder in a second direction that is opposite the first direction.

DETAILED DESCRIPTION OF THE INVENTION

Figure 1:
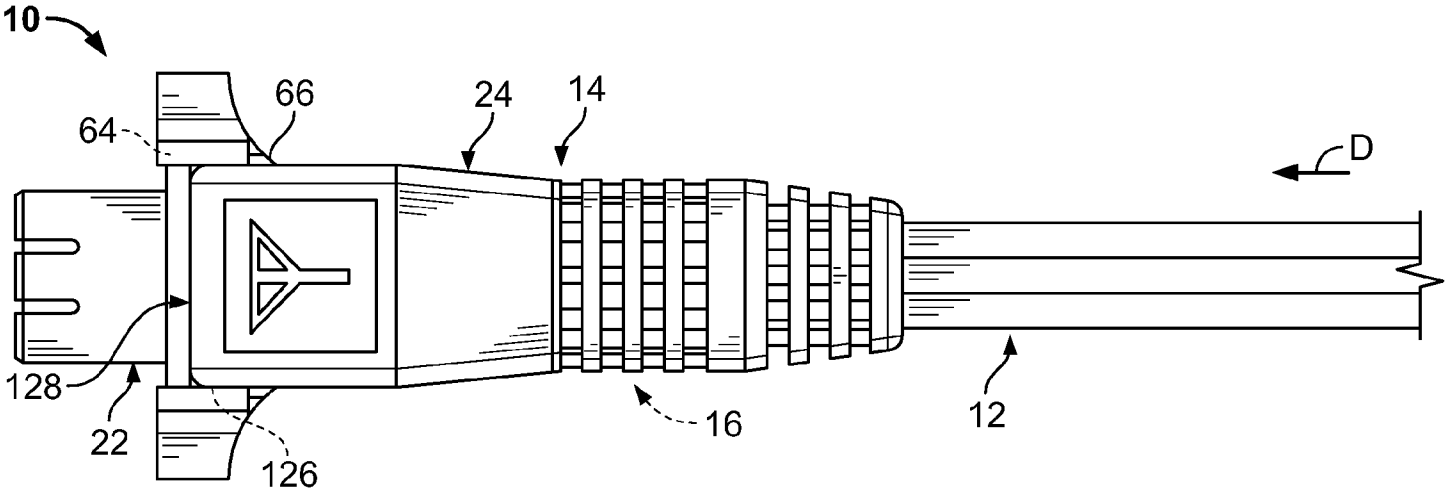
FIG. 1 is a plan view of an exemplary embodiment of an electrical connector and cable assembly.
Figure 2:
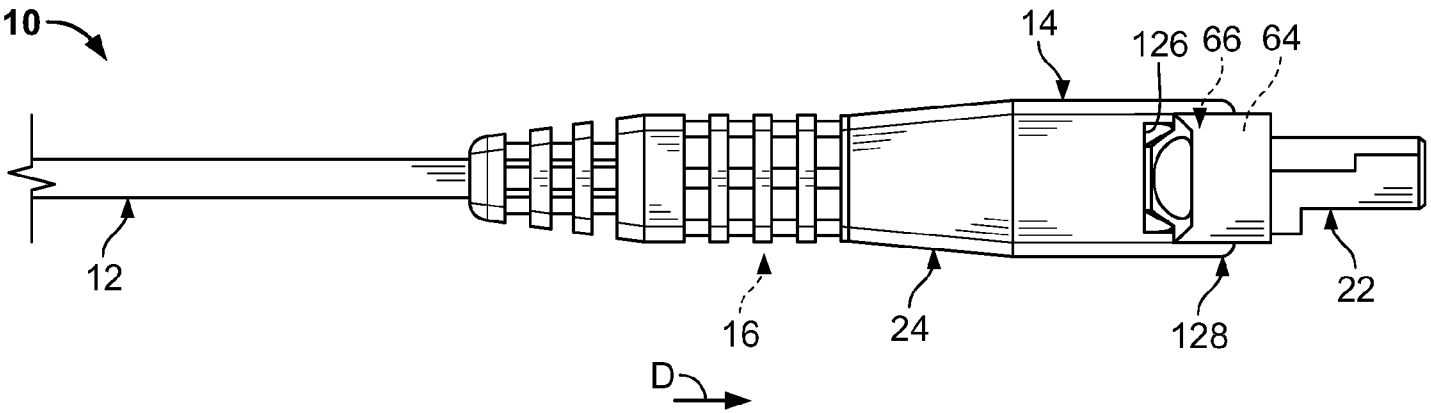
FIG. 2 is a side view of the electrical connector and cable assembly shown in FIG. 1.
Figure 3:
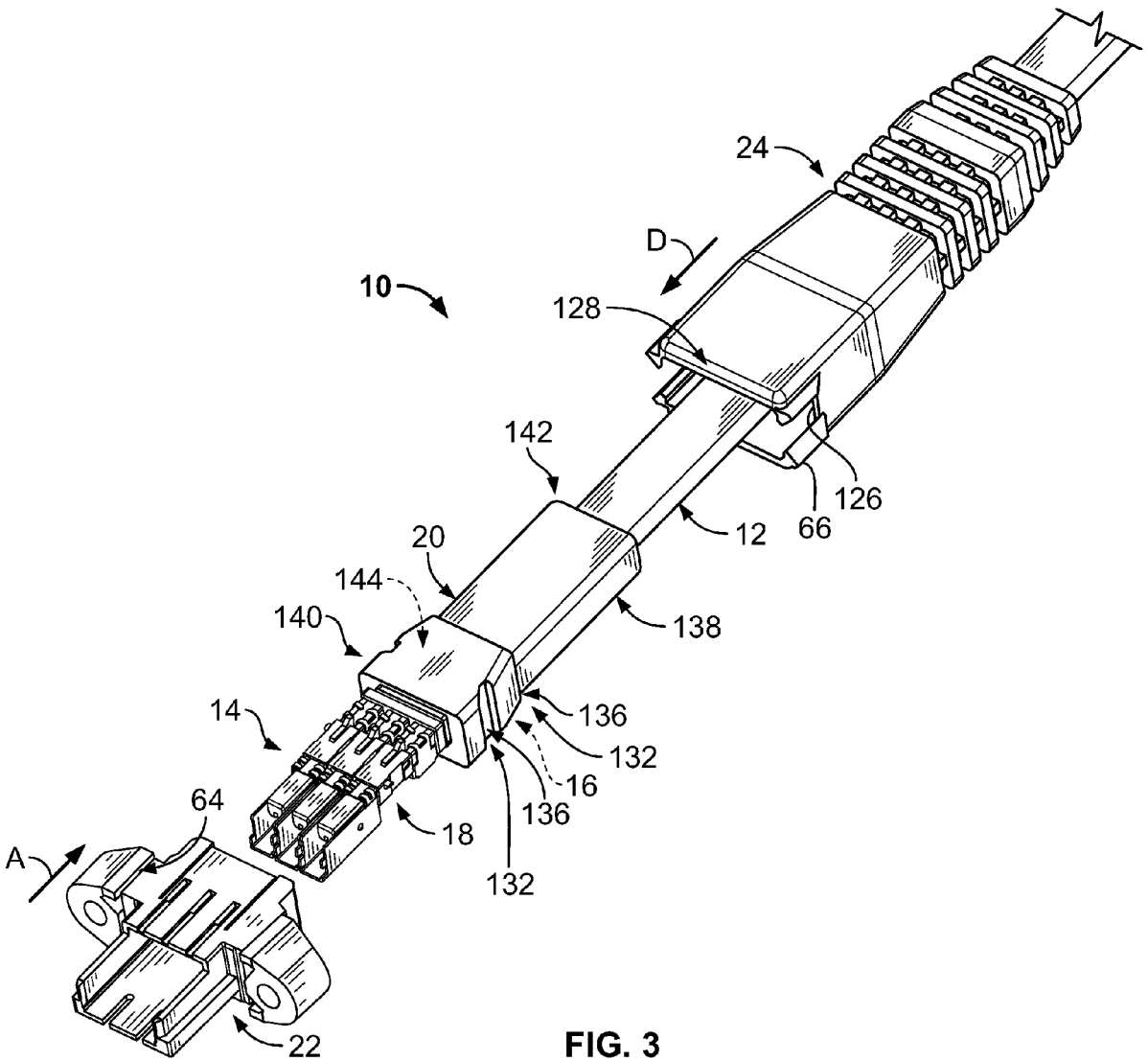
FIG. 3 is a partially exploded perspective view of the electrical connector and cable assembly shown in FIGS. 1 and 2.

FIG. 1 is a plan view of an exemplary embodiment of an electrical connector and cable assembly 10. FIG. 2 is a side view of the electrical connector and cable assembly shown in FIG. 1. FIG. 3 is a partially exploded perspective view of the electrical connector and cable assembly shown in FIGS. 1 and 2. The assembly 10 includes an electrical cable 12 and an electrical connector assembly 14 that terminates an end portion 16 (best seen in FIG. 4) of the electrical cable 12. The electrical connector assembly 14 is configured to mechanically and electrically connect with a mating connector (not shown). The electrical cable 12 may interconnect the electrical connector assembly 14 with any component (not shown), such as, but not limited to, any peripheral device, such as, but not limited to, an RF antenna, a mobile antenna, a Global Positioning System ("GPS") device, a radio device, a handheld computing device (such as, but not limited to, a Personal Digital Assistant ("PDA")), a mobile phone, an automotive telematic device, a WiFi device, a WiMax device, a data device, and/or the like. In some embodiments, the peripheral device is an antenna capable of communicating using three different frequency ranges, such as, but not limited to, a triple dipole 802.11 a/b/g/n antenna, and/or the like. The electrical connector assembly 14 may be referred to herein as a "connector sub-assembly".

The electrical connector assembly 14 includes a contact sub-assembly 18 (not visible in FIGS. 1 and 2), a cover 20 (not visible in FIGS. 1 and 2), a housing 22, and a strain relief boot 24. The cover 20 surrounds at least a portion of the end portion 16 of the electrical cable 12. The strain relief boot 24 surrounds at least a portion of the cover 20 and at least a portion of the end portion 16 of the electrical cable 12. As will be described in more detail below, the strain relief boot 24 is configured to directly connect to both the cover 20 and the housing 22.

Figure 4:
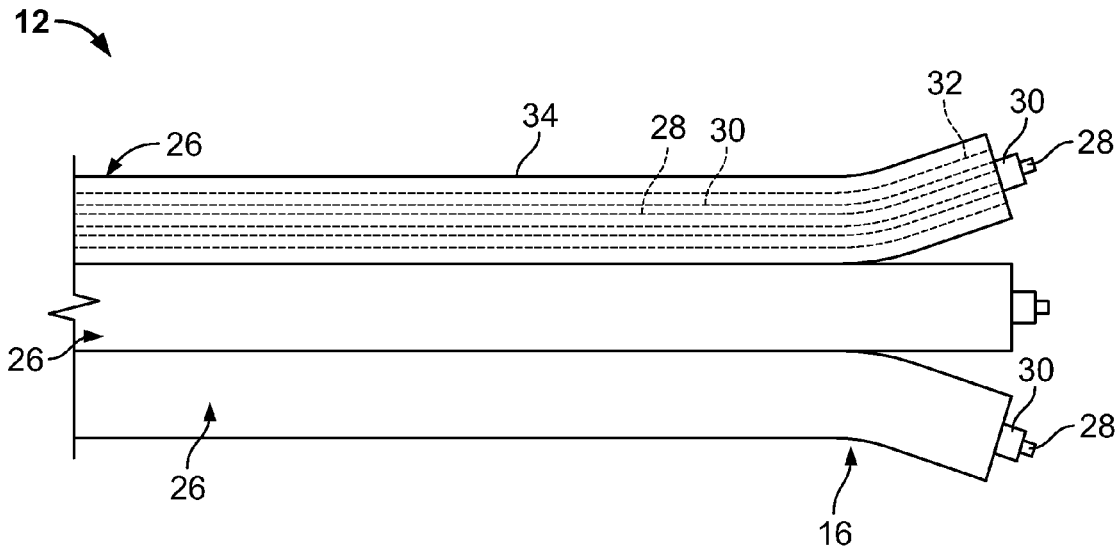
FIG. 4 is a perspective view of a portion of the electrical cable shown in FIGS. 1-3.

FIG. 4 is a perspective view of a portion of the electrical cable 12 illustrating the end portion 16 of the electrical cable 12, which is obscured in FIGS. 1-3. In the exemplary embodiment, the electrical cable 12 includes a plurality of electrical leads 26. In the exemplary embodiment, each electrical lead 26 is a coaxial cable such that each electrical lead 26 includes an inner electrical conductor 28, an electrical insulator 30 surrounding the inner electrical conductor 28, an outer electrical conductor 32 surrounding the electrical insulator 30, and an electrically insulating jacket 34 surrounding the outer electrical conductor 32. As can be seen in FIG. 2, the inner electrical conductors 28 are each exposed at the end portion 16 of the electrical cable 12 for electrical connection with corresponding electrical contacts 36 (FIGS. 8 and 10) of the electrical connector assembly 14 (FIGS. 1-3).

In alternative to the coaxial cable structure, one or more of the electrical leads 26 may include other configurations, structures, arrangements, and/or the like. For example, in some alternative embodiments, each electrical lead 26 includes only the inner electrical conductor 28 and the electrically insulating jacket 34. Although three electrical leads 26 are shown herein, the electrical cable 12 may include any number of electrical leads 26. Each electrical conductor 28 and 32 may carry electrical signals, electrical power, and/or electrical ground. Moreover, although the inner and outer electrical conductors 28 and 32 are described herein as carrying electrical energy, in some alternative embodiments the inner and/or outer electrical conductors 28 and 32, respectively, are configured to conduct something other than electrical energy, such as, but not limited to, optical conductors that are configured to conduct light, and/or the like. In the exemplary embodiment, the electrical cable 12 is a ribbon cable that includes a ribbon shape. However, the electrical cable 12 may include any other configuration, arrangement, structure, size, shape, and/or the like, such as, but not limited to, a cylindrical shape and/or the like.

Figure 5:
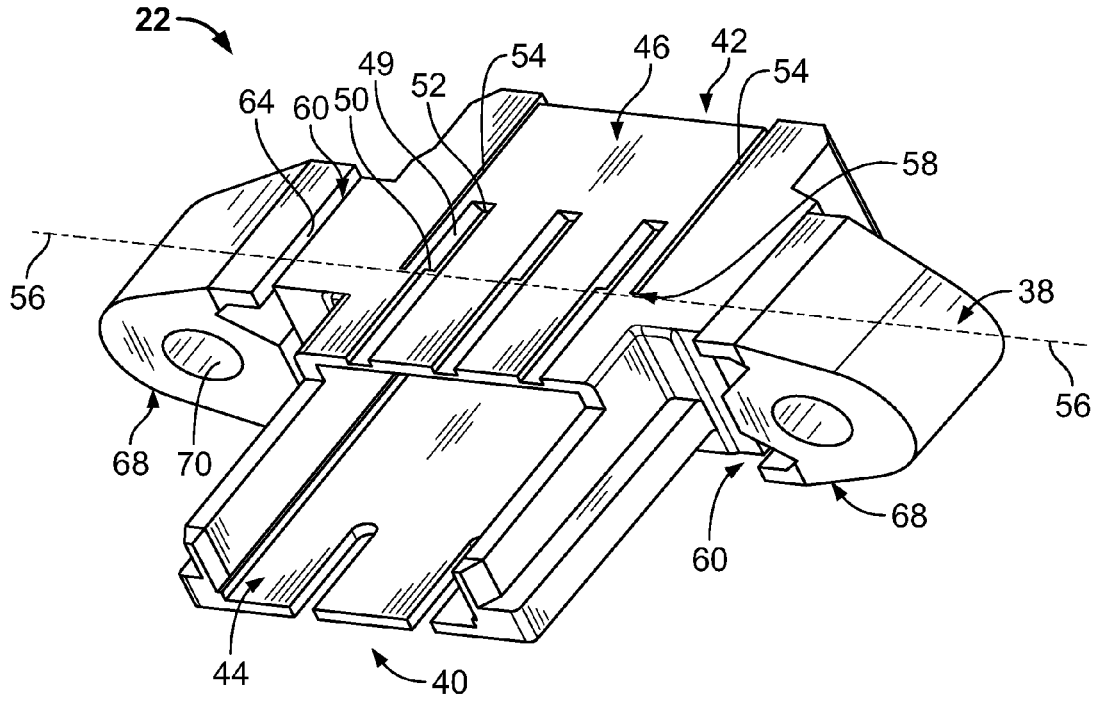
FIG. 5 is a perspective view of an exemplary embodiment of a housing of an electrical connector assembly shown in FIGS. 1-3.
Figure 6:
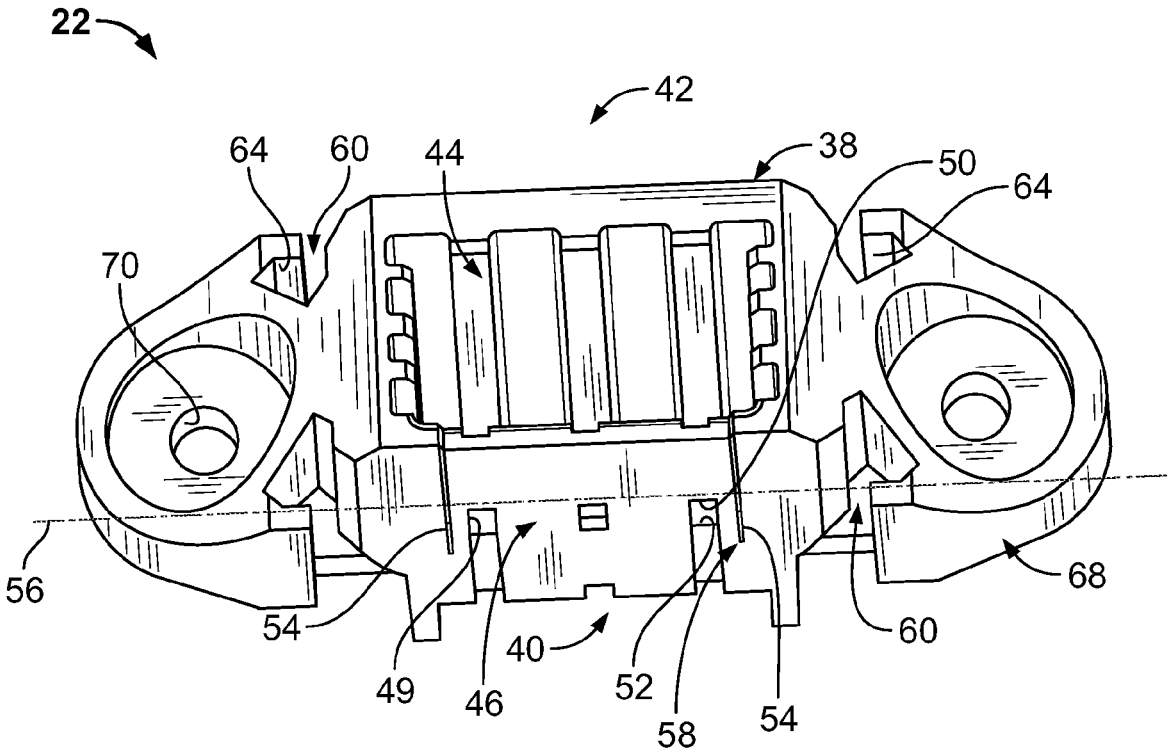
FIG. 6 is a perspective view of the housing shown in FIG. 5 viewed from a different angle than in FIG. 5.

FIG. 5 is a perspective view of an exemplary embodiment of the housing 22. FIG. 6 is a perspective view of the housing 22 viewed from a different angle than in FIG. 5. The housing 22 includes a body 38 extending a length between a pair of opposite end portions 40 and 42. The housing body 38 includes a cavity 44 that receives the contact sub-assembly 18 (FIGS. 3 and 8-11) therein, as will be described below. The housing body 38 includes a latch wall 46 for latching the housing 22 to the contact sub-assembly 18. Specifically, the latch wall 46 cooperates with one or more latch components 48 (FIG. 8) of the contact sub-assembly 18, as will be described below. In the exemplary embodiment, the latch wall 46 includes a plurality of openings 49 that extend through the latch wall 46. Each opening 49 defines a pair of stop surfaces 50 and 52. In the exemplary embodiment, the latch wall 46 is partially defined by a pair of opposite slits 54 that extend through the housing body 38. The slits 54 enable the latch wall 46 to pivot about a pivot axis 56 that is aligned with ends 58 of each of the slits 54. In the exemplary embodiment, at least the portion of the housing body 38 where the pivot axis 56 is located is resilient such that the latch wall 46 is a spring. In other words, with respect to pivoting about the pivot axis 56, the latch wall 46 is biased to the position shown in FIG. 5.

Although three openings 49 are shown, the latch wall 46 may include any number of openings 49 for cooperation with any number of latch components 48. In addition or alternative to the latch wall 46, the openings 48, and/or the stop surfaces 50 and/or 52, the housing 22 may include any other structure, means, and/or the like that enables the housing 22 to be latched to the contact sub-assembly 18. For example, in addition or alternative, the latch wall 46 may include one or more extensions (not shown) that is each received within one or more openings (not shown) of the latch components 48 of the contact sub-assembly 18. Each of the stop surfaces 50 and 52 may be referred to herein as a "first stop surface" and/or a "second stop surface".

Figure 7:
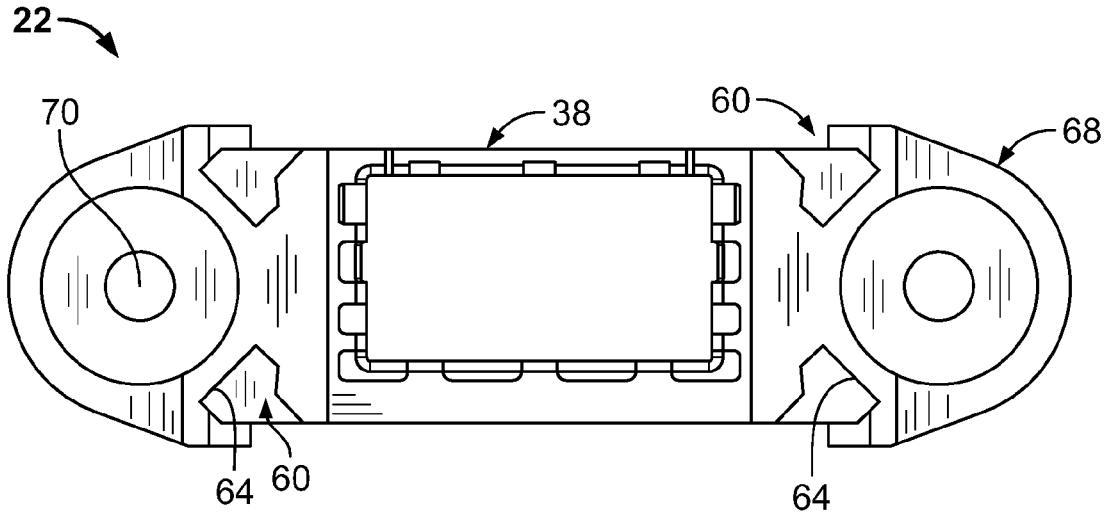
FIG. 7 is an elevational view of the housing shown in FIGS. 5 and 6.

FIG. 7 is an elevational view of the housing 22. Referring now to FIGS. 5-7, in the exemplary embodiment, the housing body 38 includes a plurality of latch components 60 for directly connecting the housing 22 to the strain relief boot 24 (FIGS. 1-3, 12-14, and 16). Specifically, each of the latch components 60 cooperates with a corresponding latch component 62 (FIGS. 12 and 13) of the strain relief boot 24, as will be described below. In the exemplary embodiment, each of the latch components 60 includes a slot 64 that receives a corresponding extension 66 (FIGS. 1-3, 12, and 13) of the latch components 62 therein. Additionally or alternatively, the latch components 60 may include any other structure, means, and/or the like that enables the latch components 60 to directly connect the housing 22 to the strain relief boot 24. For example, in addition or alternative, the latch components 60 of the housing 22 may include one or more extensions (not shown) that is each received within one or more corresponding slots (not shown) of the latch components 62 of the strain relief boot 24. Although in the exemplary embodiment the housing 22 includes four latch components 60 that each includes a single slot 64, the housing 22 may include any number of latch components 60 for cooperation with any number of latch components 62 of the strain relief boot 24. Moreover, each latch component 60 may include any number of slots 64 for each receiving any number of extensions 66. Although the slots 64 are each shown as including a triangular shape, in addition or alternative the slots 64 may each include any other shape and/or the like that enables the slots 64 to function as described and/or illustrated herein.

The housing 22 optionally includes one or more mounting ears 68 for securing the housing 22 to the mating connector (not shown) and/or a structure associated with the mating connector, such as, but not limited to, a panel to which the mating connector is mounted, and/or the like. In the exemplary embodiment, each mounting ear 68 includes an opening 70 extending therethrough for receiving a mounting fastener (not shown). Although two mounting ears 68 are shown, the housing 22 may include any number of mounting ears 68.

Figure 8:
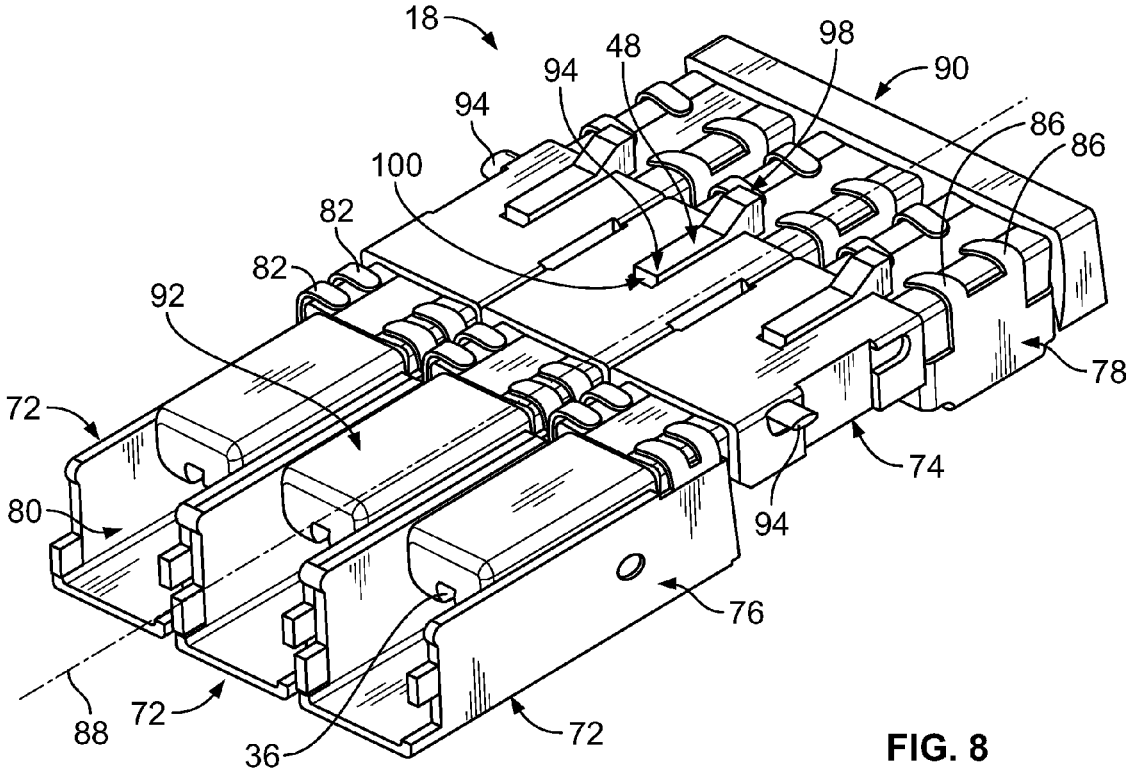
FIG. 8 is a perspective view of an exemplary embodiment of a contact sub-assembly of the electrical connector assembly shown in FIGS. 1-3.
Figure 10:
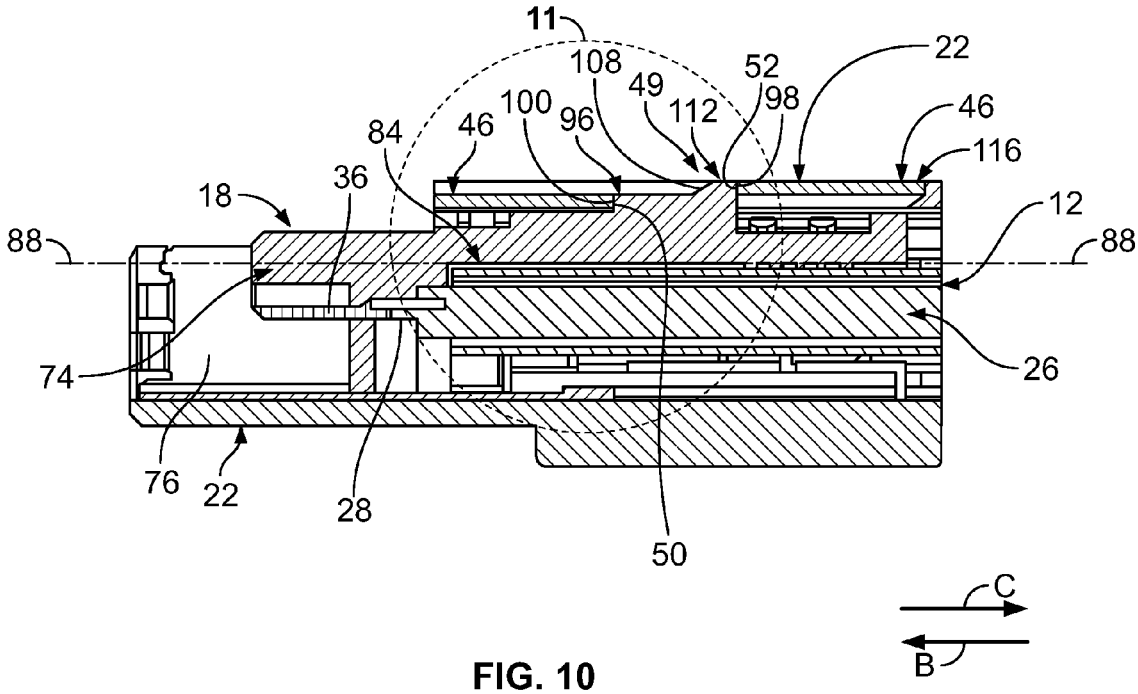
FIG. 10 is a cross-sectional view taken along line 10-10 of FIG. 9.

FIG. 8 is a perspective view of the contact sub-assembly 18. The contact sub-assembly 18 includes a plurality of plug connectors 72 that each includes a contact holder 74, one of the electrical contacts 36, an electrically conductive shield 76, and a cable strain relief member 78. In the exemplary embodiment, each plug connector 72 is configured to be received by a corresponding receptacle (not shown) of the mating connector (not shown). Alternatively, one or more of the plug connectors 72 defines a receptacle (not shown) that receives a corresponding plug (not shown) of the mating connector therein. Although three plug connectors 72 are shown, the contact sub-assembly 18 may include any number of the plug connectors 72. Referring now to FIG. 10, each electrical contact 36 of the contact sub-assembly 18 terminates, and is electrically connected to, an end portion of the inner conductor 28 of the corresponding electrical lead 26 of the electrical cable 12. Although not shown, each shield 76 may include an insulation displacement contact (IDC) that pierces the jacket 34 of the corresponding electrical lead 26 such that the shield 76 is electrically connected to the corresponding outer conductor 32.

Each electrical contact 36 may carry electrical signals, electrical power, and/or electrical ground. Although the electrical contacts 36 are described herein as carrying electrical energy, in some alternative embodiments one or more of the electrical contacts 36 are configured to conduct something other than electrical energy, such as, but not limited to, optical contacts that are configured to conduct light, and/or the like.

Referring again to FIG. 8, for each plug connector 72, the shield 76 defines a cavity 80 that receives the corresponding contact holder 74 therein such that the shield 76 surrounds a portion of the contact holder 74. In the exemplary embodiment, each shield 76 includes a plurality of clamping fingers 82 that clamp around and crimp onto the corresponding contact holder 74 to connect the shield 76 to the contact holder 74. Additionally or alternatively, one or more of the shields 76 and/or the corresponding contact holders 74 may include any other structure, means, and/or the like that enables the shield 76 to be connected to the contact holder 74.

As will be described below, each contact holder 74 includes a cable cradle 84 (FIG. 10) that holds a portion of a corresponding one of the electrical leads 26 (FIG. 4) therein. For each plug connector 72, the cable strain relief member 78 surrounds a portion of the corresponding contact holder 74 and a portion of the corresponding electrical lead 26. In the exemplary embodiment, each cable strain relief member 78 includes a plurality of clamping fingers 86 that clamp around and crimp onto the corresponding contact holder 74 to connect the cable strain relief member 78 to the contact holder 74. Additionally or alternatively, one or more of the cable strain relief members 78 and/or the corresponding contact holders 74 may include any other structure, means, and/or the like that enables the cable strain relief member 78 to be connected to the contact holder 74.

Each contact holder 74 extends a length along a central longitudinal axis 88 between a cable-receiving end portion 90 and a mating end portion 92. One or more of the contact holders 74 optionally includes one or more keying extensions 94 and/or one or more keying receptacles (not shown). The keying extensions 94 and receptacles are positioned such that the keying extension 94 of one contact holder 74 is received within the keying receptacle of an adjacent contact holder 74 to interlock the contact holders 74. The contact holders 74 may each be fabricated from any material(s) that enables the contact holders 74 to function as described and/or illustrated herein. In some embodiments, an entirety of each of the contact holders 74 is dielectric. In other embodiments, one a portion of each of the contact holders 74 is dielectric.

In the exemplary embodiment, each of the contact holders 74 includes one of the latch components 48. In the exemplary embodiment, each of the latch components 48 includes an extension 96 that includes a pair of stop shoulders 98 and 100. The latch components 48 are optionally integrally formed with some or all of the remainder of the corresponding contact holders 74. Moreover, the stop shoulders 98 and 100 are optionally integrally formed with each other.

Figure 9:
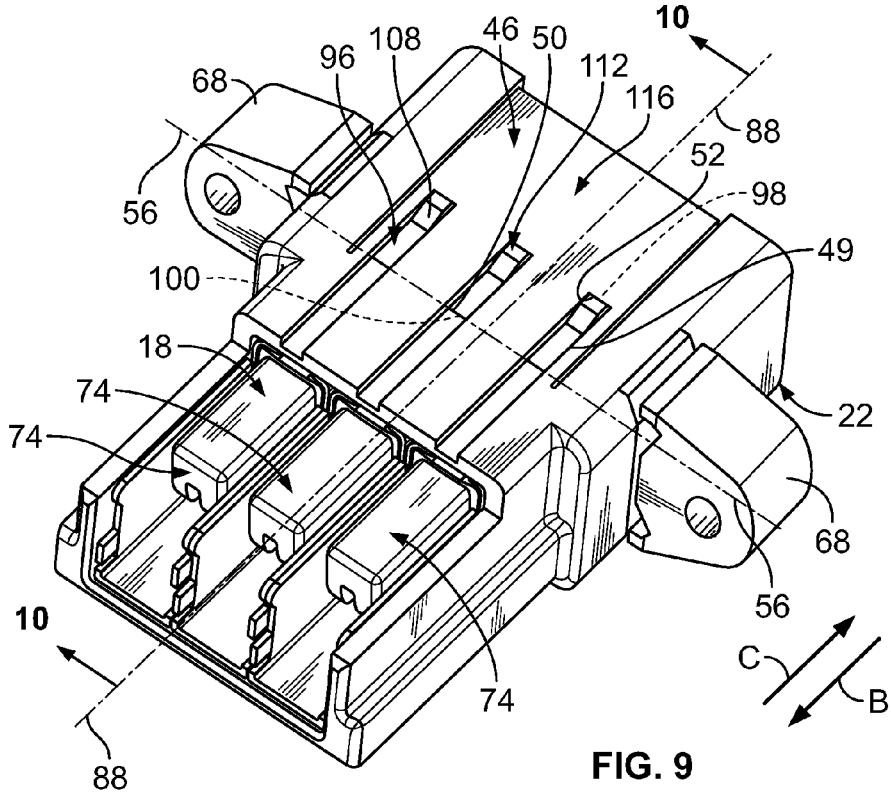
FIG. 9 is a perspective view of the housing shown in FIGS. 5-7 latched to the contact sub-assembly shown in FIG. 8.
Figure 11:
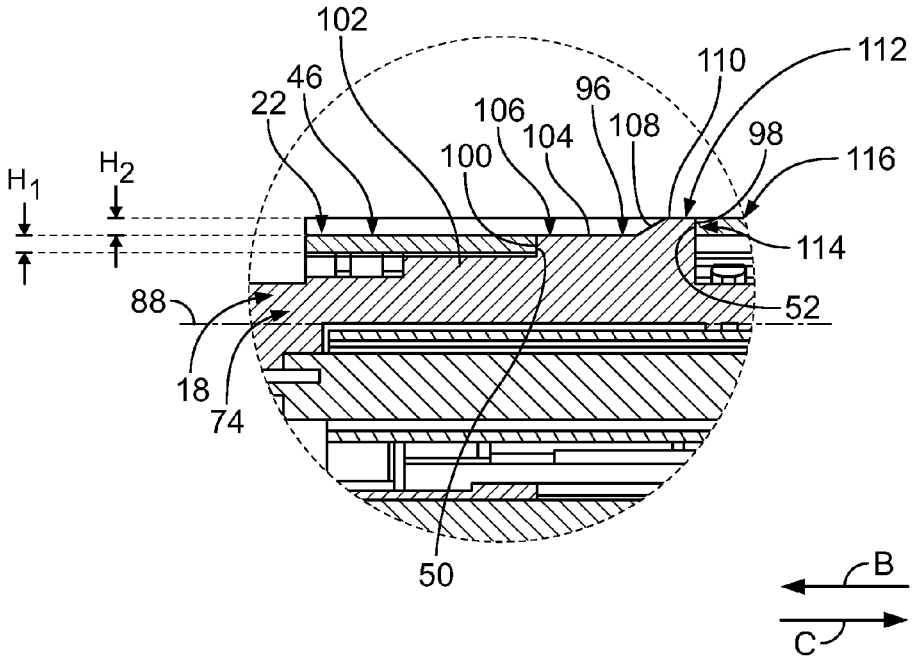
FIG. 11 is an enlarged cross-sectional view of Detail A of FIG. 10.

FIG. 9 is a perspective view of the housing 22 latched to the contact sub-assembly 18. FIG. 10 is a cross-sectional view taken along line 10-10 of FIG. 9. FIG. 11 is an enlarged cross-sectional view of Detail A of FIG. 10. Referring now to FIG. 11, each extension 96 includes a stepped structure. Specifically, for each extension 96, the stop shoulder 100 extends a height $H_1$ from a base surface 102 of the contact holder 74 to a step runner surface 104. The stop shoulder 100 and the step runner surface 104 define a step 106 of the extension 96. A ramp surface 108 extends a height $H_2$ from the step runner surface 104 to another step runner surface 110. The ramp surface 108 and the step runner surface 110 define another step 112 of the extension 96. As can be seen in FIG. 11, because of the stepped structure of the extension 96, a portion 114 of the stop shoulder 98 is located at a greater distance from the central longitudinal axis 88 than the stop shoulder 100.

Although the stop shoulder 100 is shown as extending approximately 90° relative to each of the base surface 102, the step runner surface 104, and the step runner surface 110, the stop shoulder 100 may extend at any other angle(s) relative to each of the base surface 102, the step runner surface 104, and the step runner surface 110 that enables the stop shoulder 100 to function as described and/or illustrated herein. Similarly, the stop shoulder 98 may extend at any other angle(s) than approximately 90° relative to each of the base surface 102, the step runner surface 104, and the step runner surface 110 that enables the stop shoulder 98 to function as described and/or illustrated herein. Moreover, although shown as approximately parallel, the stop shoulders 98 and 100 may extend at any angle relative to each other that enables the stop shoulders 98 and 100 to function as described and/or illustrated herein.

In addition or alternative to the extension 96 and/or any component, structure, and/or the like of the extension 96, each latch component 48 may include any other structure, means, and/or the like that enables the latch component 48 to latch the housing 22 to the contact sub-assembly 18. For example, in addition or alternative, one or more of the latch components 48 may include one or more openings (not shown) that each receives one or more extensions (not shown) of the latch wall 46 of the housing 22. Although in the exemplary embodiment the contact sub-assembly 18 includes three latch components 48 that each includes a single extension 96, the contact sub-assembly 18 may include any number of latch components 48 for cooperation with any number of openings 49 of the latch wall 46. Moreover, each latch component 48 may include any number of extensions 96 that are each received within any number of openings 49. Furthermore, each contact holder 74 may include any number of the latching components 48. In some embodiments, one or more of the contact holders 74 does not include a latching component 48. Each of the stop shoulders 98 and 100 may be referred to herein as a "first stop shoulder" and/or a "second stop shoulder".

Referring now to FIG. 3, to latch the housing 22 to the contact sub-assembly 18, the housing 22 is moved over the contact sub-assembly 18 in the direction of the arrow A of FIG. 3. Referring now to FIGS. 9-11, as the housing 22 is moved over the contact sub-assembly 18, engagement between the latch wall 46 and the contact holders 74 causes the latch wall 46 to pivot about the pivot axis 56 (not visible in FIGS. 10 and 11). Specifically, a portion 116 of the latch wall 46 engages the ramp surfaces 108 of the extensions 96. Pivoting about the pivot axis 56 enables the portion 116 of the latch wall 46 to clear the second steps 112 of the extensions 96. Once the portion 116 of the latch wall 46 has cleared the second steps 112, the bias of the latch wall 46 causes the latch wall 46 to pivot back into the position shown in FIGS. 9-11 such that each extension 96 is received within the corresponding opening 49 within the latch wall 46. When the extensions 96 are received within the corresponding openings 49 as shown in FIGS. 9-11, the housing 22 is prevented from being moved along the central longitudinal axis 88 relative to the contact holders 74 in either of a pair of opposite directions B and C. Specifically, each stop surface 52 engages the corresponding stop shoulder 98 to prevent the housing 22 from moving in the direction B, while each stop surface 50 engages the corresponding stop shoulder 100 to prevent the housing from moving in the direction C.

Figure 12:
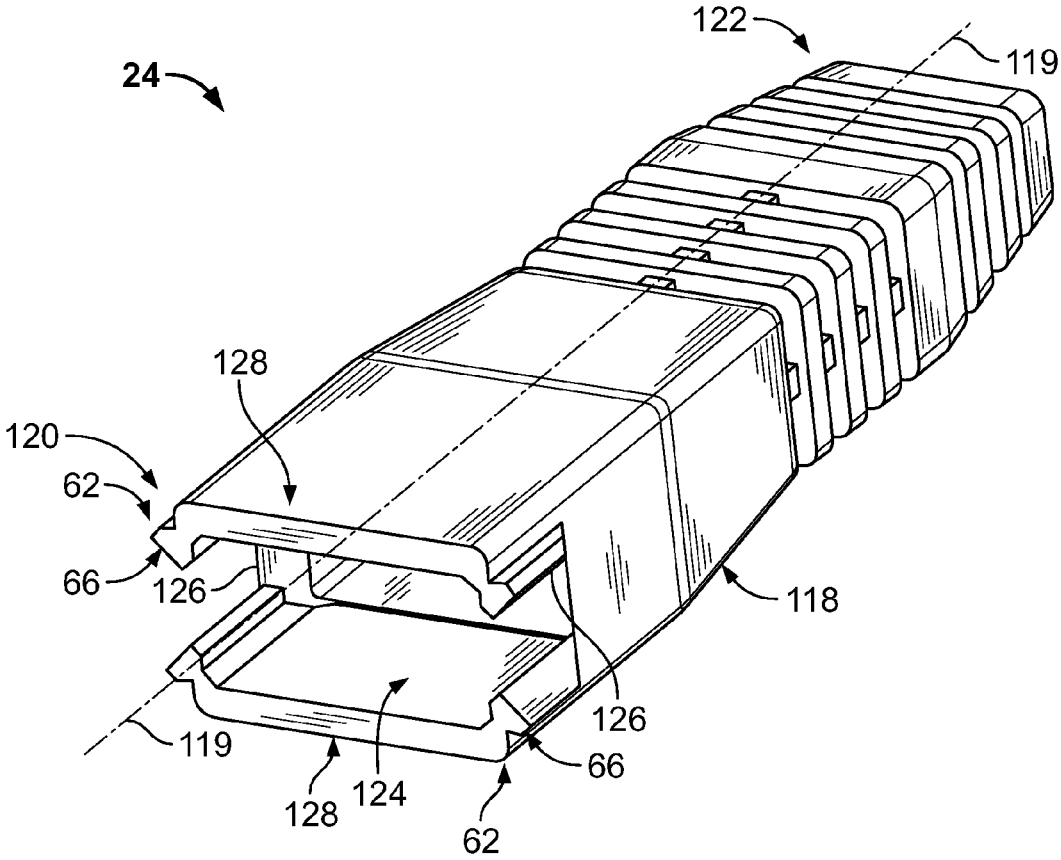
FIG. 12 is a perspective view of an exemplary embodiment of a strain relief boot of the electrical connector assembly shown in FIGS. 1-3.

FIG. 12 is a perspective view of an exemplary embodiment of the strain relief boot 24. The strain relief boot 24 includes a body 118 extending a length along a central longitudinal axis 119 between a pair of opposite end portions 120 and 122. The body 118 defines a cavity 124 for receiving the cover 20 (FIGS. 3, 15, and 16) therein. The end portion 120 of the strain relief boot 24 includes a pair of opposite slots 126. As will be described below, each slot 126 receives a portion of the housing 22 (FIGS. 1-3, 5-7, and 9-11) therein. The slots 126 define flaps 128 at the end portion 120 of the strain relief boot 24 that overlap the housing 22 such that the end portion 120 of the strain relief boot 24 overlaps the housing 22, as will also be described below.

Figure 13:
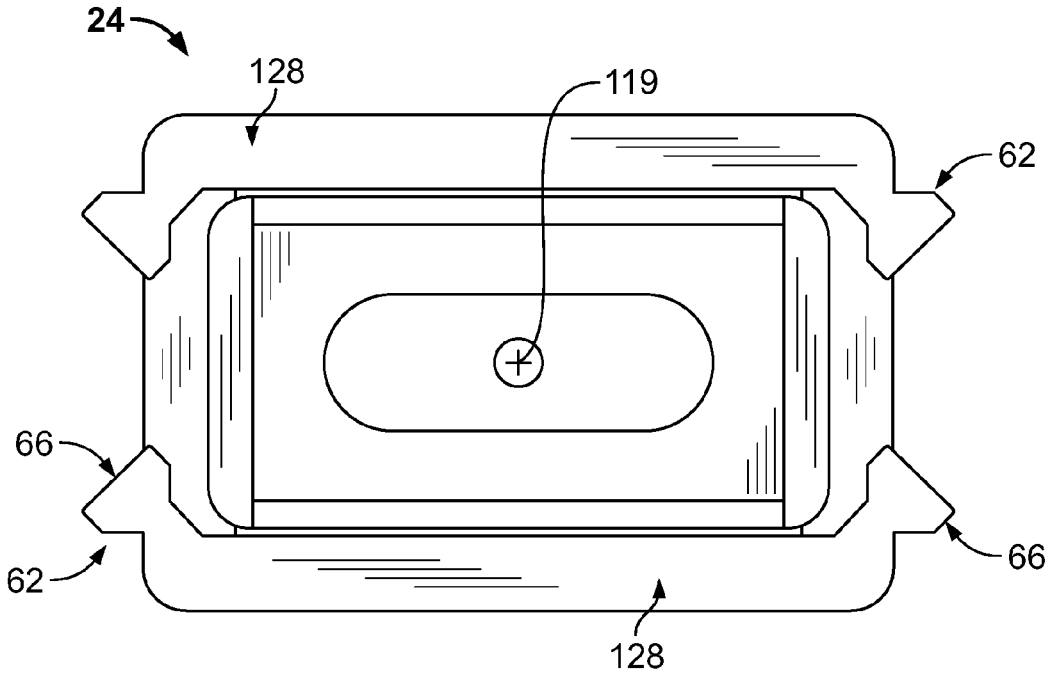
FIG. 13 is an elevational view of the strain relief boot shown in FIG. 12.

FIG. 13 is an elevational view of the strain relief boot 24. Referring now to FIGS. 12 and 13, as described above, the strain relief boot 24 includes the latch components 62 that cooperate with the latch components 60 (FIGS. 5-7) of the housing 22 to directly connect the strain relief boot 24 to the housing 22. In the exemplary embodiment, each of the latch components 62 includes one of the extensions 66. Each extension 66 extends outwardly from a corresponding one of the flaps 128. In addition or alternative to the extensions 66, the latch components 62 may include any other structure, means, and/or the like that enables the latch components 62 to directly connect the strain relief boot 24 to the housing 22. For example, in addition or alternative, the latch components 62 of the strain relief boot 24 may include one or more slots (not shown) that each receives one or more corresponding extensions (not shown) of the latch components 60 of the housing 22. Although in the exemplary embodiment the strain relief boot 24 includes four latch components 62 that each includes a single extension 66, the strain relief boot 24 may include any number of latch components 62 for cooperation with any number of latch components 60 of the housing 22. Moreover, each latch component 62 may include any number of extensions 66, each for reception within any number of slots 64. Although the extensions 66 are each shown as including a triangular shape, in addition or alternative the extensions 66 may each include any other shape and/or the like that enables the extensions 66 to function as described and/or illustrated herein. Each of the latch components 62 may be referred to herein as a "housing latch component".

Figure 14:
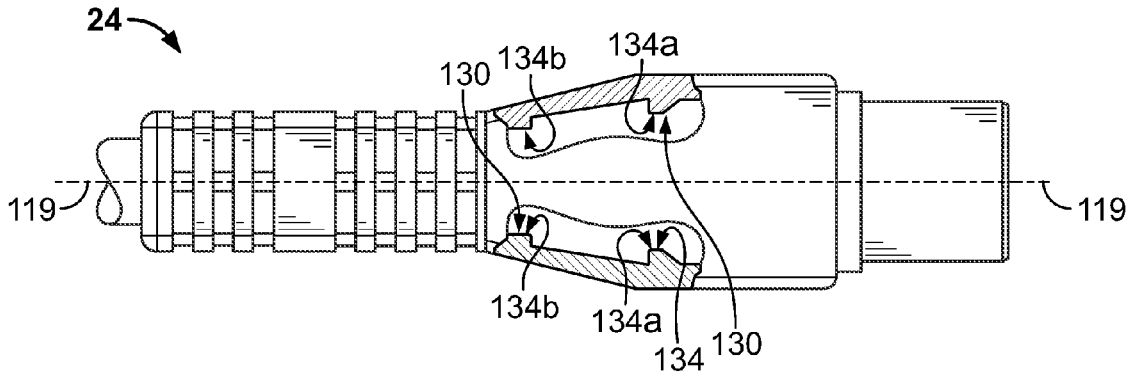
FIG. 14 is a partially broken away plan view of the strain relief boot shown in FIGS. 12 and 13.
Figure 15:
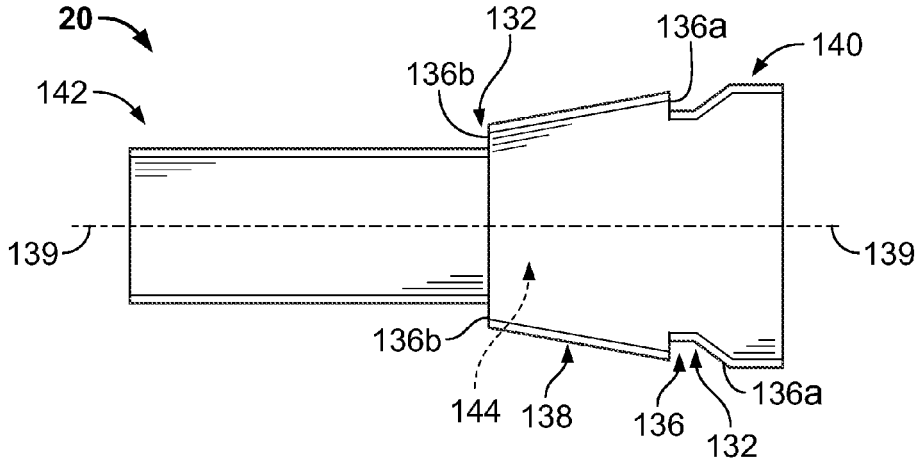
FIG. 15 is a plan view of an exemplary embodiment of a cover of the electrical connector assembly shown in FIGS. 1-3.
Figure 16:
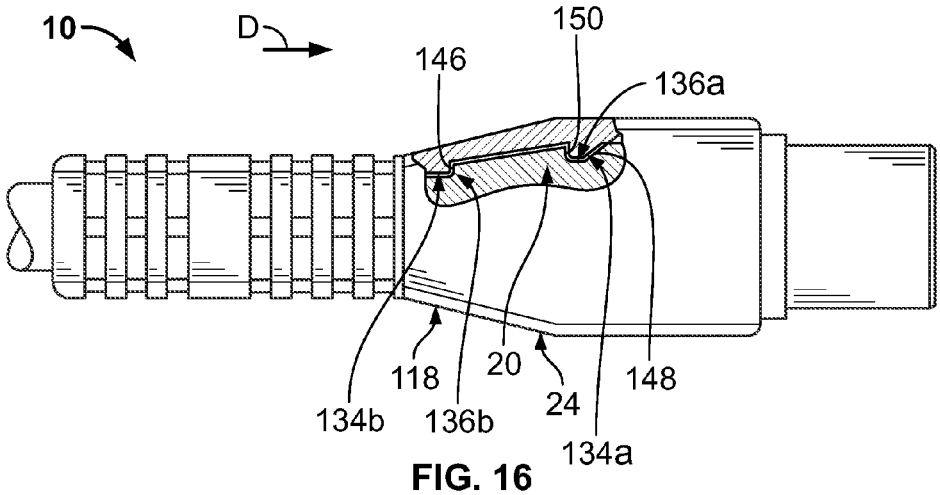
FIG. 16 is a partially broken away plan view of a portion of the electrical connector and cable assembly shown in FIGS. 1-3 illustrating direct connection between the cover and the strain relief boot.

FIG. 14 is a partially broken away plan view of the strain relief boot 24. The strain relief boot 24 includes a plurality of latch components 130 for directly connecting the strain relief boot to the cover 20 (FIGS. 3, 15, and 16). Specifically, each of the latch components 130 cooperates with a corresponding latch component 132 (FIGS. 3 and 15) of the cover 20, as will be described below. In the exemplary embodiment, each of the latch components 130 includes a protrusion 134 that is received by a corresponding groove 136 (FIGS. 3, 15, and 16) of the latch components 132 of the cover 20. Some of the protrusions 134*a* are located at different axial locations along the central longitudinal axis 119 of the strain relief boot 24 from other protrusions 134*b*.

In addition or alternative to the protrusions 134, the latch components 130 may include any other structure, means, and/or the like that enables the latch components 130 to directly connect the strain relief boot 24 to the cover 20. For example, in addition or alternative, the latch components 130 of the strain relief boot 24 may include one or more grooves (not shown) that each receives one or more corresponding protrusions (not shown) of the latch components 132 of the cover 20. Although in the exemplary embodiment the strain relief boot 24 includes four latch components 130 that each includes a single protrusion 134, the strain relief boot 24 may include any number of latch components 130 for cooperation with any number of latch components 132 of the cover 20. Moreover, each latch component 130 may include any number of protrusions 134, each for reception within any number of grooves 136. In addition or alternative to the shapes shown herein, the protrusions 134 may each include any other shape and/or the like that enables the protrusions 134 to function as described and/or illustrated herein. Each of the latch components 130 may be referred to herein as a "cover latch component".

FIG. 15 is a plan view of an exemplary embodiment of the cover 20. Referring now to FIGS. 3 and 15, the cover 20 includes a body 138 extending a length along a central longitudinal axis 139 (not labeled in FIG. 3) between a pair of opposite end portions 140 and 142. The body 138 defines a cavity 144 for receiving the end portion 16 (FIGS. 1-4) of the electrical cable 12 (FIGS. 1-4 and 10) therein. As described above, the cover 20 includes the latch components 132 that cooperate with the latch components 130 (FIG. 14) of the strain relief boot 24 to directly connect the strain relief boot 24 to the cover 20. In the exemplary embodiment, each of the latch components 132 includes one of the grooves 136. Some of the grooves 136*a* are located at different axial locations along the central longitudinal axis 139 of the cover 20 from other grooves 136*b*.

Additionally or alternatively, the latch components 132 may include any other structure, means, and/or the like that enables the latch components 132 to directly connect the strain relief boot 24 to the cover 20. For example, in addition or alternative, the latch components 132 of the cover 20 may include one or more protrusions (not shown) that is each received within one or more corresponding grooves (not shown) of the latch components 130 of the strain relief boot 24.

Although in the exemplary embodiment the cover 20 includes four latch components 132 that each includes a single groove 136, the cover 20 may include any number of latch components 132 for cooperation with any number of latch components 130 of the strain relief boot 24. Moreover, each latch component 132 may include any number of grooves 136, each for receiving any number of protrusions 134. In addition or alternative to the shapes shown herein, each groove 136 may include any other shape and/or the like that enables the grooves 136 to function as described and/or illustrated herein.

FIG. 16 is a partially broken away plan view of a portion of the electrical connector and cable assembly 10 illustrating direct connection between the cover 20 and the strain relief boot 24. To directly connect the strain relief boot 24 to the cover 20, the strain relief boot 24 is moved over the cover in the direction of the arrow D (also shown in FIG. 3). As the strain relief boot 24 is moved over the cover 20, the body 118 of the strain relief boot 24 deflects to enable the protrusions 134*a* to clear a shoulder 146 of each of the grooves 136b. Specifically, a ramp surface 148 of each of the protrusions 134*a* engages a corresponding one of the shoulders 146 to deflect the body 138. Once the protrusions 134*a* clear a shoulder 150 of the grooves 136*a*, the body 118 of the strain relief boot 24 returns from the deflection such that each of the protrusions 134*a* and 134*b* is received within the corresponding groove 136*a* and 136*b*, respectively. Reception of the protrusions 134 within the grooves 136 directly connects the strain relief boot 24 to the cover 20.

Referring again to FIGS. 1-3, to directly connect the strain relief boot 24 to the housing 22, the strain relief boot 24 is moved toward the housing 22 in the direction of the arrow D. As the strain relief boot 24 is moved toward the housing 22, each of the extensions 66 of the strain relief boot 24 is received within the corresponding slot 64 within the housing 22. Reception of the extensions 66 within the slots 64 directly connects the strain relief boot 24 to the housing 22. Moreover, a portion of the housing 22 is received within the slots 126 of the strain relief boot 24 such that the flaps 128 overlap a portion of the housing 22. Because the flaps 128 include the extensions 66, when the electrical cable 12 is bent the flaps 128 do not peel away from the housing 22.

Although the embodiments described and/or illustrated herein are described and illustrated herein with reference to an electrical cable and an electrical connector, the embodiments described and/or illustrated herein are not limited to electrical connectors and electrical cables. Rather, the embodiments described and/or illustrated herein may be used with any type of connector and any type of cable, such as, but not limited to, optical connectors and optical cables.

The embodiments described and/or illustrated herein may provide strain relief to a housing of a connector that terminates the end portion of a cable. For example, the embodiments described and/or illustrated herein may provide strain relief to the housing 22 and/or the cover 20.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the fill scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly for terminating an end portion of a cable that includes a conductor, said connector assembly comprising:

a housing;

a contact held by the housing, the contact being configured to be connected to the conductor of the cable;

a cover configured to surround at least a portion of the end portion of the cable; and a strain relief boot configured to surround at least a portion of the cover and at least a portion of the end portion of the cable, wherein the strain relief boot comprises a cover latch component that is configured to directly connect the strain relief boot to the cover, and wherein the strain relief boot comprises a housing latch component that is configured to directly connect the strain relief boot to the housing.

2. The connector assembly according to claim 1, wherein the housing latch component of the strain relief boot comprises an extension and the housing comprises a slot, the extension being configured to be received within the slot to directly connect the strain relief boot to the housing.

3. The connector assembly according to claim 1, wherein the strain relief boot comprises a slot that is configured to receive a portion of the housing therein.

4. The connector assembly according to claim 1, wherein at least a portion of an end portion of the strain relief boot is configured to overlap the housing.

5. The connector assembly according to claim 1, wherein the housing comprises a slot and the strain relief boot comprises an end portion having a flap that is configured to overlap the housing, the flap comprising the housing latch component.

6. The connector assembly according to claim 1, wherein the cover latch component of the strain relief boot comprises a protrusion and the cover comprises a groove, the protrusion being configured to be received within the groove to directly connect the strain relief boot to the cover.

7. The connector assembly according to claim 1, wherein the strain relief boot extends a length along a longitudinal axis, the cover latch component of the strain relief boot comprising a plurality of protrusions that are located at different axial locations along the longitudinal axis, the cover comprising a plurality of grooves, each of the protrusions being configured to be received within a corresponding one of the grooves to directly connect the strain relief boot to the cover.

8. A connector and cable assembly comprising:

a cable comprising an end portion and a conductor; and a connector sub-assembly terminating the end portion of the cable, the connector sub-assembly comprising:

a housing;

a contact held by the housing, the contact being connected to the conductor of the cable;

a cover surrounding at least a portion of the end portion of the cable; and a strain relief boot surrounding at least a portion of the cover and at least a portion of the end portion of the cable, wherein the strain relief boot is directly connected to both the cover and the housing.

9. The connector and cable assembly according to claim 8, wherein the strain relief boot comprises an extension and the housing comprises a slot, the extension being received within the slot to directly connect the strain relief boot to the housing.

10. The connector and cable assembly according to claim 8, wherein the strain relief boot comprises a slot, a portion of the housing being received within the slot.

11. The connector and cable assembly according to claim 8, wherein an end portion of the strain relief boot overlaps the housing.

12. The connector and cable assembly according to claim 8, wherein the housing comprises a slot and the strain relief boot comprises an end portion having a flap that overlaps the housing, the flap comprising an extension that is received within the slot to directly connect the flap to the housing.

13. The connector and cable assembly according to claim 8, wherein the strain relief boot comprises a protrusion and the cover comprises a groove, the protrusion being received within the groove to directly connect the strain relief boot to the cover.

14. The connector assembly according to claim 8, wherein the strain relief boot extends a length along a longitudinal axis, the strain relief boot comprising a plurality of protrusions that are located at different axial locations along the longitudinal axis, the cover comprising a plurality of grooves, each of the protrusions being received within a corresponding one of the grooves to directly connect the strain relief boot to the cover.

15. The connector assembly according to claim 8, wherein the contact of the connector sub-assembly comprises an electrical contact and the conductor of the cable comprises an electrical conductor, the electrical contact being electrically connected to the electrical conductor.

16. The connector assembly according to claim 8, wherein the contact of the connector sub-assembly comprises an optical contact and the conductor of the cable comprises an optical conductor, the optical contact being optically connected to the optical conductor.

17. A connector comprising:

a contact holder extending a length along a longitudinal axis, the contact holder comprising a latch component having a first stop shoulder and a second stop shoulder;

a contact held by the contact holder; and a housing holding the contact holder, the housing comprising a latch wall having a first stop surface and a second stop surface, the first stop surface being configured to engage the first stop shoulder of the contact holder to prevent the housing from moving along the longitudinal axis relative to the contact holder in a first direction, the second stop surface being configured to engage the second stop shoulder of the contact holder to prevent the housing from moving along the longitudinal axis relative to the contact holder in a second direction that is opposite the first direction;

wherein the latch component of the contact holder comprises a ramp, the latch wall of the housing being pivotable about a pivot axis, and wherein engagement between the latch wall and the ramp as the housing is moved over the contact holder causes the latch wall to pivot about the pivot axis.

18. The connector according to claim 17, wherein the longitudinal axis is a central longitudinal axis of the contact holder, the latch component comprising a stepped structure such that at least a portion of the second stop shoulder is located at a greater distance from the central longitudinal axis than the first stop shoulder.

19. The connector according to claim 17, wherein the latch wall comprises a spring.

* * * * *